US005400621A

United States Patent [19]

Smejda

[11] Patent Number: 5,400,621

[45] Date of Patent: Mar. 28, 1995

[54] FLEXIBLE MACHINERY FOR THE CONTINUOUS PROCESSING OF ANY AXIALLY CENTERED MASSES; MATERIALS AND SHEETING IN TEXTILES, PAPER, PLASTICS, METALS; AND COMBINATIONS

[76] Inventor: Richard K. Smejda, P.O. Box 344, Patterson, N.J. 07544

[21] Appl. No.: 45,789

[22] Filed: Apr. 14, 1993

[51] Int. Cl.[6] ..... D06B 3/14

[52] U.S. Cl. ..... 68/5 C; 68/11; 68/8; 68/5 D

[58] Field of Search ..... 68/5 D, 5 C, 5 E, 8, 68/7, 10, 11, 3 R, 17 R, 207; 134/201, 56 D

[56] References Cited

U.S. PATENT DOCUMENTS

| | | | |
|---|---|---|---|
| 4,494,389 | 1/1985 | Smejda | 68/5 C |
| 4,984,439 | 1/1991 | Smejda | 68/5 C |
| 5,241,844 | 9/1993 | Nakanishi | 68/5 C |
| 5,267,455 | 12/1993 | Dewees et al. | 68/5 C |

*Primary Examiner*—Frankie L. Stinson

[57] ABSTRACT

A system for the processing of any substrates, masses, and materials, using a plurality of multifunctional workstations in numerous variations and combinations to obtain a huge range of capabilities for the use of stacking multipliers, gentle internal processing, gravity drives, and free generation of electricity.

17 Claims, 11 Drawing Sheets

12
22
1
A
B
C
D
E
F
G
H
I
J
2
3
4
5
8
9
10
11
13
14
15
16
17
18
19
20
21
23
27
28
29
45
46
K
F
A
G
J

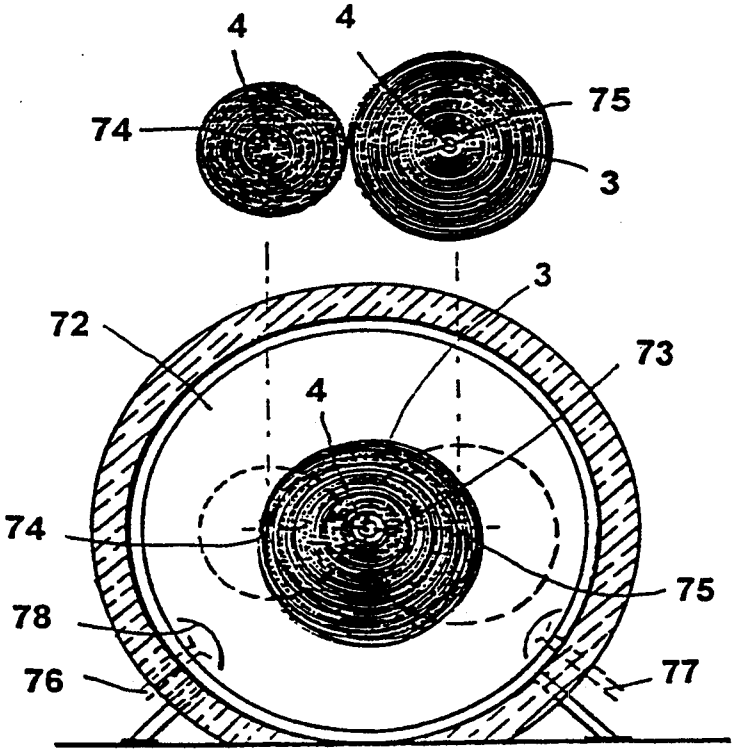
FIG. 13
FIG. 11
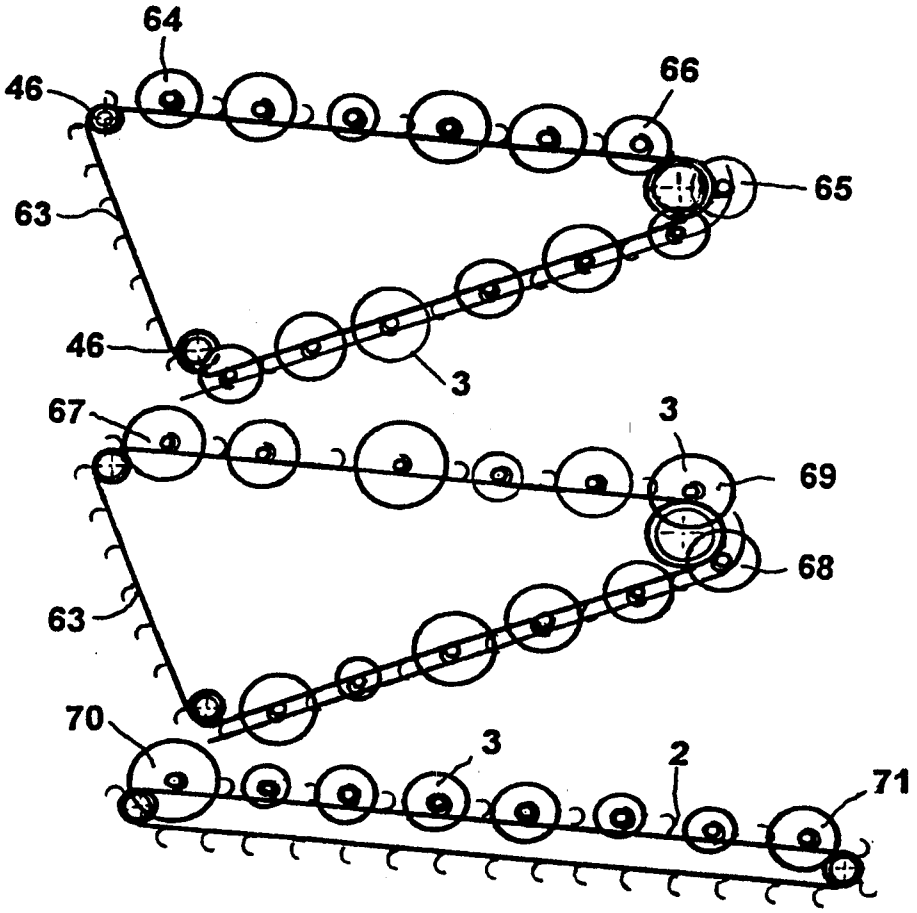

FLEXIBLE MACHINERY FOR THE CONTINUOUS PROCESSING OF ANY AXIALLY CENTERED MASSES; MATERIALS AND SHEETING IN TEXTILES, PAPER, PLASTICS, METALS; AND COMBINATIONS

BACKGROUND OF THE INVENTION

1. Field of the Invention

This invention describes the functionality of self-propelling, compound conveyor systems combined with the triple continuity of; substrate preparation; substrate processing; and substrate/material development and finishing It describes mainly the application to fibrous materials, but is applicable to a wide variety of temperature treated substrates, materials, and masses.

This invention relates to machinery, systems, and processes for the treatment of continuous sheeting, materials, and axially centered masses in a gravity propelled storage area filled with air, gases, vapors and their combinations and kept at controlled temperatures, as desired from cryogenic up to the melting point of the substrates under treatment. The temperature of the volume of the substrates is regulated by the controlled temperature differential of the medium surrounding the substrates surface. The medium providing the volumes control is colder than the substrate below zero degree Celsius and hotter above zero degrees in order to provide a temperature stability. All temperatures affecting the action are sensor controlled and adjustable to suit a large variety of substrates and processes. These conveyor equipped processing chambers are augmented by state of the art preparation ranges before,—and development/washing/finishing ranges after,—the thermal treatment and processing chambers. It is a triple continuity between preparation ranges, thermal and chemical processing, and development/finishing systems, using the two crossover points to switch between a variety of multiple, differentiated preparation units, the highly flexible conveyor treatment, and the multiple differentiated finishing systems. Solid, or amorphous, axially centered masses of any shape, are simply held and rotated along the centerline of gravity and processed according to the requirements of the trade. While this invention has a very wide area of application, it will be illustrated for reasons of simplification mostly for textile fibers and related materials in forms and shapes wound on rotating cores.

In all cases of long sheetings of any material, but especially in case of moist impregnated substrates, strands of fibers, or compound layers, the systems are organized into multiple lines of substrate preparation, with or without drying, and transferred to timed heat treatment in steam, vapors, or air, and optionally developed, washed, and finished for delivery. Any step may be entered repeatedly in order to improve further on the state of the intermixed discontinuous and continuous operations. The processing in cold, heat and/or moisture, is modified by any addition of steam-, electric-, electromagnetic, dielectric-combustion-, ultrasound-, pressure, or chaotic/turbulent energies, in combination with an environment of vapors, gases, air, liquids, controlled powders, or any of them.

2. Description of the Prior Art

This invention improves on and adds to the disclosures in the U.S. Pat. Nos. 4,494,389, 4,984,439, and the copending application Ser. No. 07/907,609 of this inventor and is part of a new technology disclosed in further copending applications. It improves operational flexibility, increases the scope of processing, improves economy and ecology, and uses plant space more efficiently by superimposing stacking conveyors of varying dimensions with higher and longer treatment potential. The variety of conveyor lengths also permits to store in sequence masses of substrates destined for different duration of processing by selection of the optimal conveyor length. Instead of having to organize substrates in waves of increasing and decreasing processing periods accompanied by slow changes in the conveyor speed the length of the conveyor determines the optimal time zone. Conveyor speeds are still adjustable but the range within each conveyor is characterized by its length and has a lower amplitude fitting between the adjacent conveyors. Numerous types of conveyors are used to permit continuous processing of a multitude of materials with entirely new flexibility in the use of continuous and semicontinuous operations.

SUMMARY OF THE INVENTION

It is an object of this invention to slice a commonly rectangular triangle of the conveyor chamber into multiple sections parallel to the hypotenuse with the purpose of creating progressively shorter slices usable for the location of increasingly smaller conveyor units, each with its own processing timing and to combine all of them within the same energy field.

It is therefore an object of this invention to increase the flexibility of present continuous operations by providing at least one changeover point; for example at the beginning of color application and/or before washing and finishing. One or more diversified preparation ranges deliver lots and substrates for processing to the multitiered conveyors and place them in the selected, variable timeslots of longer conveyors for longer, and shorter conveyors for shorter processing times. After the prescribed exposure these lots are expulsed and again selectively distributed to two, or more, washing and finishing units. A very large number of processing combinations is possible, due to the variegated components within a variety of interchangeable processing groups.

It is an object of this invention to widen the temperature range of the processing system from cryogenic treatment to just under the melting temperature of the substrates and masses.

It is an additional object to process any axially centered matrix, or mass, or substrates on cores, inside the conveyor steamer either open, or tied, with permeable wraps at temperatures above the boiling point of the impregnation,—or covered with impermeable wraps, or with shells, either in steam, or in heated gases, or air, while processing the substrates below the boiling point of the impregnation. The materials are processed under varied pressures.

It is another object to employ the large and uninterrupted heat sink of these complex processing systems efficiently and dispose ecologically correct any surplus steam emanating from electrical power generators.

It is an object to use tension control in winding for the production of accurately controlled and repeatable processing of tight, slack, or loose rolls of elongated substrates on specific orders, but controlled and variable from lot to lot, regardless of any specific conveyor used, and in an infinitely variable mix of textile fibers, yarns, shapes, styles, blends, colors, and treatments.

It is another object to save space and energy in operations by stacking multiple conveyors of increasing length above each other, or combining two or more sets of such multiple conveyors within complex processing units.

It is a further object of this improvement to organize conveyor systems for forward, parallel, up and down, and reverse delivery of masses and substrates.

It is another object to reduce handling further by employing multiple processing levels above each other, with the materials cascading progressively downwards for the use of free gravity.

It is an additional object to equip conveyors with brake/motors for the startup of operations, but convertible to power generators as soon as the requisite kinetic energy is stored and using the combined potential energy of the inclined masses pressing against the conveyor stops for the generation of power.

It is an object to rotate substrates by gravity forces on open conveyors or in chambers, under atmospheric or artificial pressure, in the presence of steam, gases, air, chemical substances, and liquids or powders, for the achievement of controlled and repeatable reactions.

It is another object to provide simultaneously processing times from minutes to many hours on the stacked conveyor lines, while delivering masses, matrices, and impregnated sheeting rolled on cores for further handling, and to continue this operation without contamination and without stoppage of the treatment chamber for days and weeks.

It is a further object to process all masses, materials, and substrates in dry or wet condition, and to switch from step to step, as desired, with or without intermediate drying.

It is an object to improve flexibility with a varied composition of two or more conveyor systems operating-in parallel having a variety of modules, with the ability to handle a multitude of substrates and materials simultaneously, and to adapt the operating speeds, chemical formulations, and treatment variables, on all preparation ranges, conveyor set-ups, and washing/finishing ranges to the satisfaction of highly variable customer standards.

Other objects and advantages will become apparent from the following description in conjunction with the accompanying drawings.

BRIEF DESCRIPTION OF THE DRAWINGS

FIG. 11 is a schematic sideview of three combined conveyor systems with five entry and five exit possibilities.

FIG. 13 is a schematic frontview of the autoclave with loose roll, or rewinding in vacuum or pressure conditions.

DESCRIPTION OF THE PREFERRED EMBODIMENTS

Figures 1, 2A, 2B:
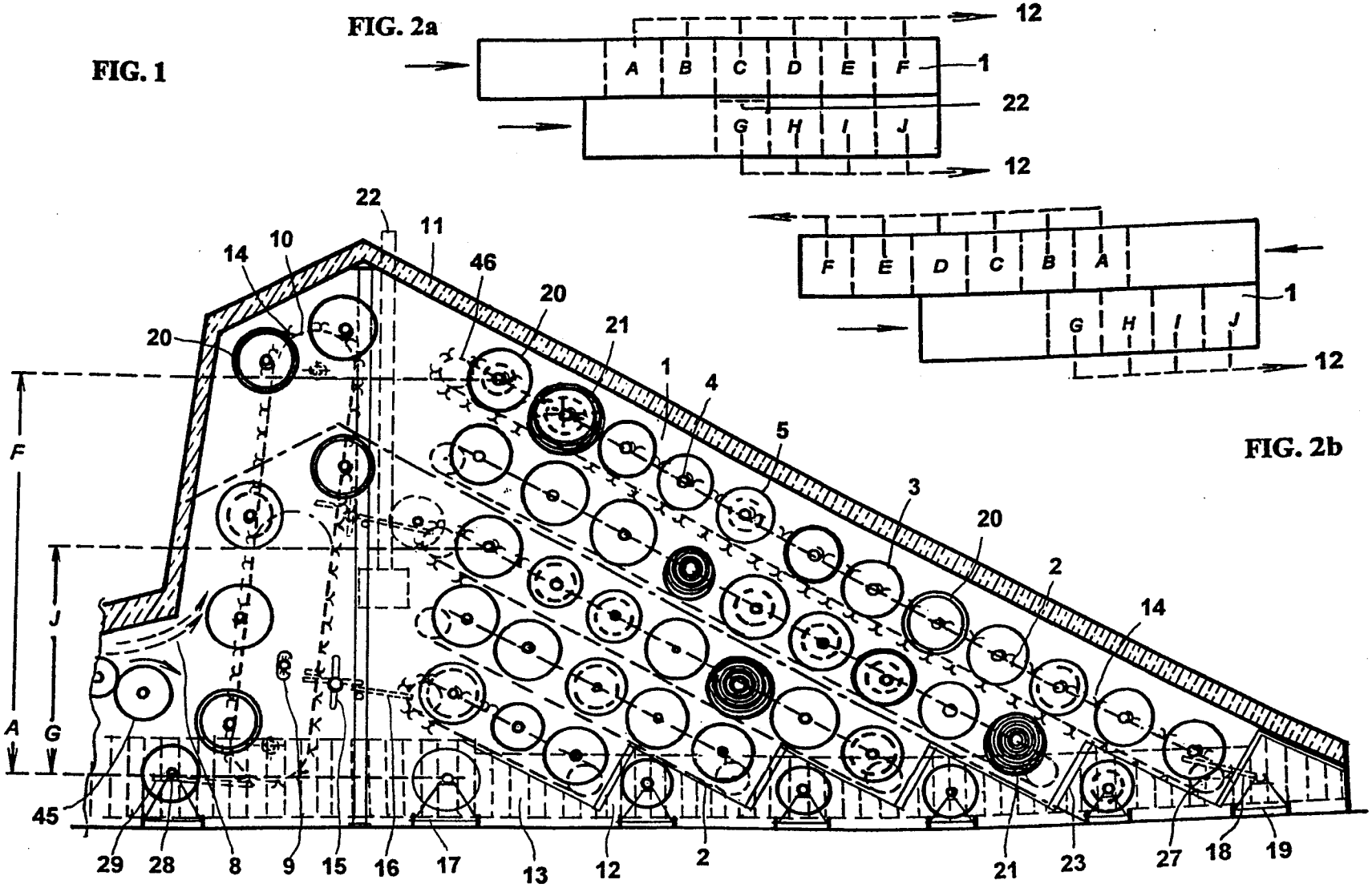
FIG. 1 is a schematic sideview in section showing the supply of substrates wound on cores, plus the elevation and delivery to the conveyor system.
FIG. 2*a* is a schematic topview of FIG. 1 with parallel processing of two conveyor systems combined in the same housing.
FIG. 2*b* is a schematic topview of the systems in 2*a*, using reverse processing.

The components of the conveyor ranges 1 consist generally of highly flexible processing conveyors 2, used singly, or in multiple sets, together with applicators, loading, heating, winding and rewinding, dwelling, and unloading/discharge to the carrier. They are complemented by diversified preparation—, and washing/finishing lines in the case of textile materials. One dual stacking conveyor, for one-way or return operation, with a double line of six and four conveyors 2, is indicated schematically in FIG. 1.

The six conveyors 2; A, B, C, D, E, and F, have an average carrying capacity of 1, 3, 5, 7, 9, and 12 lots of substrates 3, each wound around the center core 4, while the companion conveyors G, H, I, and J carry as average 1, 3, 5, and 7 lots 3, with a combined loading capacity from A to J of 53 lots. Postulating a median length of 2000m per lot 3, the dual conveyor system has a loading capacity of 106.000 linear meters. Each lot is stored in the appropriate timeslot convenient for a specific conveyor length. If the conveyors G–J are used for a return/two-bath operation, for example; first dispersed dyes at 100 C. in A–F and the return line G–J for fiber-reactive dyes at 40 to 100 C., the load capacity would be reduced to 37 lots with 74.000 meters because of the repeat operation. Of course all or any part of the ten conveyors 2, can be used for one-bath, two-bath, or one-step, two-step operations. Fabric styles, fiber compositions, dyestuff groups, as well as scouring, bleaching, and dyeing can be mixed on the conveyors in any shape or form.

The stacking conveyors jointly with preparation and washing/finishing ranges can handle the majority of present discontinuous operations with increased efficiency, higher quality, better economy, and much less waste. The FIGS. 2*a* and 2*b* show a top view of two arrangements of the systems in FIG. 1.

Each lot 3 can be dyed or treated for any timeperiod from minutes to sixteen hours, or more. All of the lots 3 in process may be of the same color, or anyone lot, or all lots 3 may be different. They may be of the same cloth, or of any mix of fabrics and blends. Of course other materials and substrates may be intermixed with the textile lots.

Lots 3 do not touch each other, nor the stacking steamer. There is no contamination of the conveyor-system for days, or weeks. No stoppage for cleaning is required. Only the color- and chemical-applicators are cleaned. Wherever needed two applicators are supplied for each conveyor and the second applicator may be started when the first is only half loaded. This can double production figures in case of short dyeing times and quick rotation of the conveyor lots 3.

The regulation of processing temperature is easy, if boiling water is the principal impregnation, and the boiling temperature is about 100 degrees Celsius at 760 mm Hg, each lot 3 is delivered to the conveyor already at the boil and this condition is maintained by the steam envelope within the system kept at a designated temperature above the boil. However boiling is just a subgroup between cryogenic and near-melting temperature.

Figure 4:
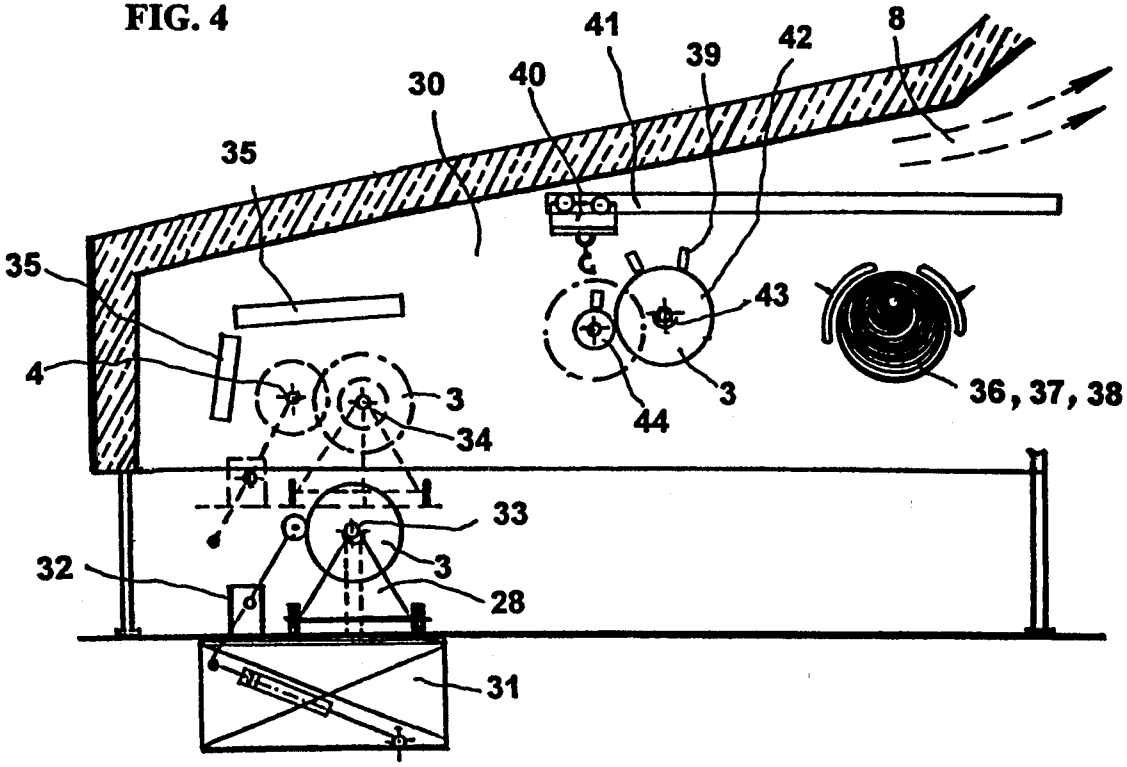
FIG. 4 is a schematic sideview of the treatment chamber for FIG. 1 showing winding and energizing.

Steam and wasteheat is supplied by the connection 8 from the chamber 1 (two arrows) to the energy generators and steam emanation in the treatment area 30 (FIG. 4). Additional steam injection 9 is combined with other energy sources and heat exchangers to adjust temperature according to convenience. It is channeled into the conveyor chamber 1 as processing energy in correspondance with the prior art established by this inventor. The chamber 1 is completely enclosed in a bell-shaped housing by the insulation 11 covering its outer perimeter down to exit area 12 of the lots 3. At this point the working area is protected from heat and steam by flexible, transparent flaps 13 and by exhaust channels at the rim of area 12 (not shown) syphoning off small amounts of excess steam.

Because of the increased interaction with supporting ranges there must be additional access from the floor to the elevator 10 distributing the lots 3 to the individual conveyors 2. At the summit of the chains of elevator 10 gravity causes the lots 3 to roll downward until caught by the upper curve of the next left and right hooks 14. From here the lots 3 descend in order to be picked off by the interference rails 15 rotated by ninety degrees at the point of intersection to the selected conveyor 2. Each conveyor 2 also has a pair of fixed rails 16. From the rails 15 the lots 3 roll by gravity force over the rails 16 into contact with the conveyor chains 2 and await the next pair of double hooks 14 coming up from below to start the rotation on the designated conveyor 2.

The lots 3 are held at two extremities of the core 4 (FIG. 3) by the double curve of the hooks 14 on the two elevator chains 2 engaging the journals 24 of the cores 4. As stated in previous patents of this inventor the journals 24 are equipped with the gear 25 to cause the rotation of the core when in contact with the inclined rack fixed to the tracks of the conveyor 2. They also carry the bearing 26 in contact with the hooks 14 on the conveyor chains 2, transfering the partial pressure resulting from the angle of the inclined load on core 4 to the chains in addition to the partial pressure of all other cores loaded to the same conveyor chains 2. Each set of conveyor chains is connected at the exit area by one shaft 27 connecting the two chains to one small DC-motor geared very highly and acting as drive and brake at start-up until the chain is sufficiently loaded to be activated by the kinetio energy of the combined weight of all cores 4 with lots 3 pressing downward. At this point in time the dc-motor is switched to a dc-generator, acting as power source and adjustable brake at the same time. The offloading rail 18 lifts the load on the exiting core 4 over the connecting shaft 27 into the brackets 28 of the A-frame 19 for removal.

At the upper loading end the two sprockets 46 of the two conveyor chain 2 are not connected by a shaft but kept separate in order to leave room for the volume of the lot 3 and the entering core 4 to pass between the sprockets as they are loaded to a pair of double hooks 14.

Numerous forms and shapes of lots 3 may be rotated on the conveyors 2. From axially centered masses of irregular or preformed shapes to the elongated wound substrates of flat sheeting or fibrous substrates of any provenience. The environment may vary from cryogenic to high temperatures, and from vacuum to pressurized autoclaves. This invention simply designs means for the rotational transportation of materials on a declining path within a controlled environment of vapor, gases, moisture, powders, and a mix of energy sources.

Because of the economical significance this specification describes in large measure loads of elongated sheetings. They are shown on the rotating working A-frame 17 placed movably on a pair of rails and on the five upper conveyor B to F.

The substrates marked lot 3 are wound in two colors on top of each other, or wound tight at substrate 3, or moderate, or loose at triple-load 21. They may be wrapped in any shape or form as implied at 20.

The stacking capacity in FIG. 1 of 106.000 linear meters relates to the reserved space of about 1250 mm per lot 3 with a diameter of 1200 mm plus 50 mm space between lots of an average length of 2000 m. Of course lots 3 of intermediate size, for example 600 mm, 850 mm diameter, etc., may be used to fit on intermediate stops of the conveyor. Also small lots, for example of 200 m of length, plus 450 m, plus 1200 m, even in different colors, may be wound on one roll and processed on the same lot 3. The height of each conveyor space is designed to fit the most convenient range of diameters for the substrates/lots 3, as they are wound on the core 4 for processing. Since fabric structures and thicknesses vary widely, the lengths wound on a roll of 1200 mm diameter are also highly variable. All figures and dimensions are variable examples.

The less dyeing time is used for each lot 3, the faster conveyor space is vacated for the next lot, and more production is delivered. This presupposes enough chemical applicators and winding systems to deliver the next load on time.

Table 1 illustrates a random example of one full capacity utilization of the system in the FIGS. 1, 2*a* and 2*b*:

TABLE 1

Load of 2000 m, each has; 1200 mm diameter; and 50 mm spacing; 250 mm forward transport for each turn of the fabric roll 3,-this requires five rotations to provide 1250 mm space for the next roll.

| LOAD | LENGTH | WIND./ | EACH | SPACE | WIND. + REWD | TIME | TOTAL | LOADS | DYEG. IN |
|---|---|---|---|---|---|---|---|---|---|

TABLE 1-continued

Load of 2000 m, each has; 1200 mm diameter; and 50 mm spacing; 250 mm forward transport for each turn of the fabric roll 3,-this requires five rotations to provide 1250 mm space for the next roll.

| 1 a) | CONVR. | MIN. | TURN | FREE | HALF | CONV. | PROCS | 24 hrs | 24 hours |
|---|---|---|---|---|---|---|---|---|---|
| A-1 | 2.0 m | 80 m | 6 min. | 30 min. | 25 min. | 30 min. | 55 min. | 48 | 2.640 min. |
| B-3 | 4.0 m | 100 m | 8 min. | 40 min. | 20 min. | 100 min. | 120 min. | 36 | 4.320 min. |
| C-5 | 6.5 m | 135 m | 3 min. | 15 min. | 15 min. | 78 min. | 93 min. | 96 | 8.928 min. |
| D-7 | 9.0 m | 80 m | 12 min. | 60 min. | 25 min. | 550 min. | 575 min. | 24 | 13.800 min. |
| E-9 | 12.0 m | 80 m | 10 min. | 50 min. | 25 min. | 480 min. | 505 min. | 29 | 14.645 min. |
| F-12 | 15.0 m | 90 m | 5 min. | 25 min. | 22 min. | 300 min. | 322 min. | 57 | 18.354 min. |
| 1 a) TOTAL LOADS: 290 = 580.000 m/TOTAL DYEING PER DAY: 1.044 hours | | | | | | | | | |
| LOAD 1 b) | LENGTH CONVR. | WIND./ MIN. | EACH TURN | SPACE FREE | WIND. + REWD HALF | TIME CONV. | TOTAL PROCS | LOADS 24 hrs | DYEG. IN 24 hours |
| G-1 | 2.0 m | 100 m | 6 min. | 30 min. | 20 min. | 25 min. | 45 min. | 48 | 2.160 min. |
| H-3 | 4.0 m | 100 m | 4 min. | 20 min. | 20 min. | 64 min. | 84 min. | 72 | 6.048 min. |
| I-5 | 6.5 m | 100 m | 2 min. | 10 min. | 20 min. | 52 min. | 72 min. | 144 | 10.368 min. |
| J-7 | 9.0 m | 100 m | 3 min. | 15 min. | 20 min. | 108 min. | 128 min. | 96 | 12.288 min. |
| 1 b) DAILY LOADS: 360 = 720.000 m/DYEING PER DAY: 514 hours | | | | | | | | | |
| 1 a) plus 1 b) = 1.300.000 m/COMBINED DYEING/DAY: 1.558 hours | | | | | | | | | |
| COMBINED LOADS: 650/AVERAGE DELIVERY INTERVAL = 2.2 minutes/2000 m | | | | | | | | | |

The variable dyeing times per lot are selected in this example of 10 operating groups as: 45, 55, 72, 84, 93, 120, 128, 322, 505, and 575 minutes. The ranges operate several days without stopping, they are not contaminated and require infrequent cleaning, only the chemical applicators on the floor are cleaned at changes of formulations. Since each conveyor controls its own time characteristic only minor adjustments in processing time (conveyor speed) are required to suit the changing types of lots 3.

The forward configuration (FIG. 2*a*) or the return configuration (FIG. 2*b*) are a means to influence the location of the preparation-and washing/finishing-ranges within the plant. Table 1 quotes examples of 580.000 m/day for the system 1*a* and 720.000 m/day for system 1*b*. The auxiliary preparation and finishing ranges are preferably run at lower speeds to provide more time exposure per segment and more support ranges providing a higher diversity through numbers. Quoting an average of 50 m/min., or 72.000 m/24 hours it can require 7 preparation- and 7 finishing-ranges for system 1*a*, and 10 plus 10 ranges for system 1*b*. Since each range can consist of different machinery elements, such as conventional wash boxes, converted discontinuous processing equipment arranged in series,—and new combined one-way-; two-way-; three-way-; up-down-; horizontal-; and down-up-conveyor systems. This innovation offers very high flexibility and variety of support.

Figure 3:
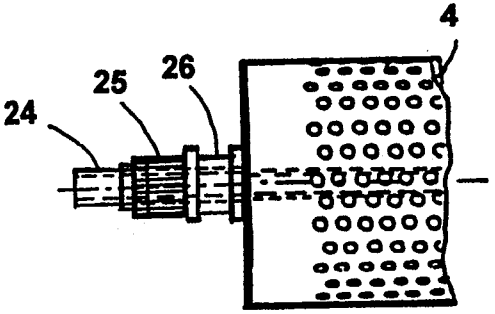
FIG. 3 is a schematic sideview of the active parts of one extremity of core 4, showing a hollow shaft used the insertion of liquids and/or gases.
Figure 5B:
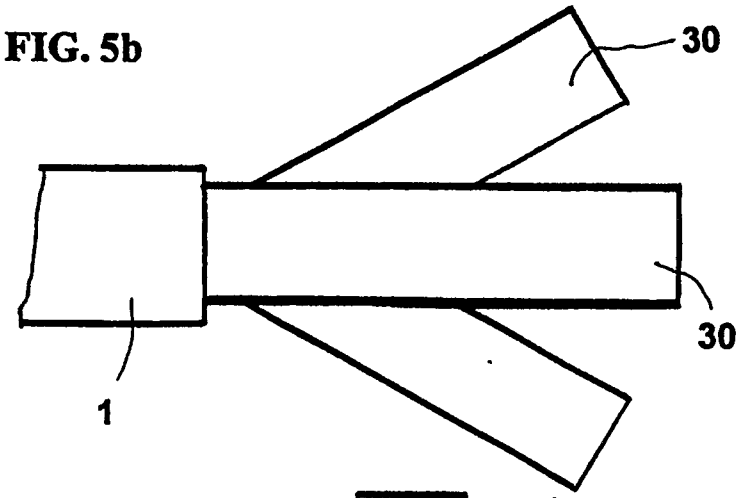
FIG. 5 is a schematic top view of multiple treatment chambers.
Figure 5D:
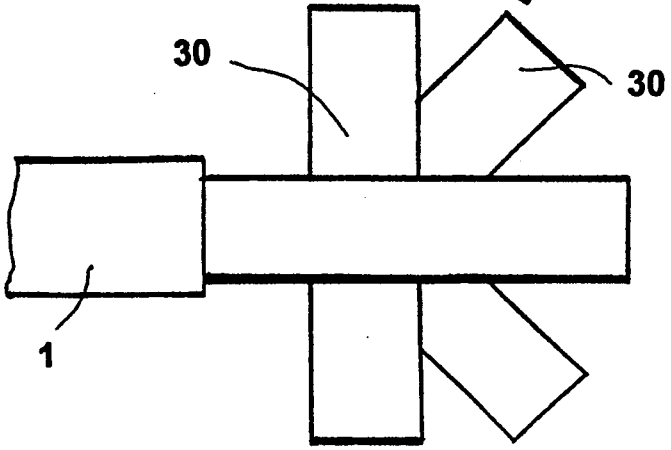
Figure 5A:
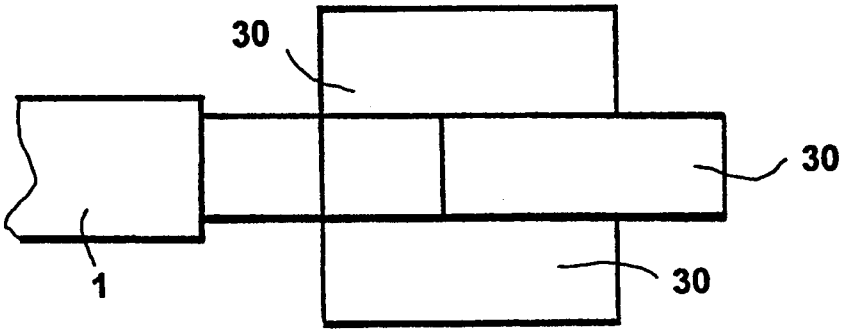
Figure 5C:
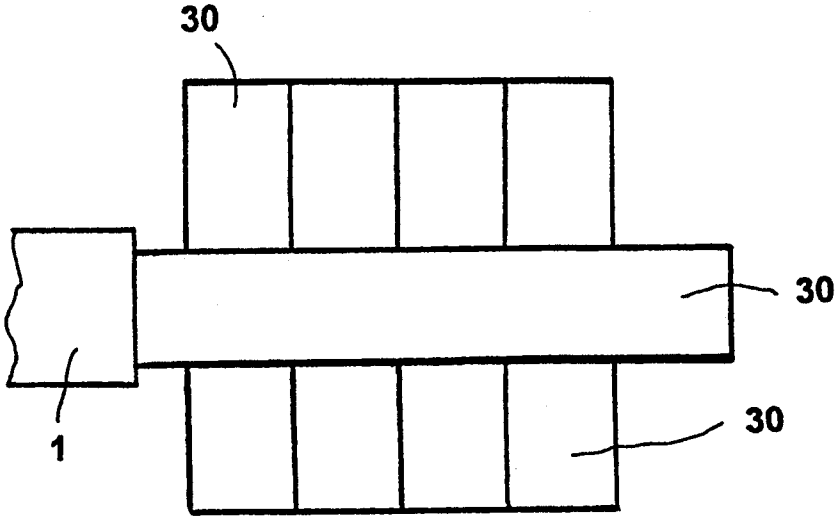

The cores 4 according to FIG. 3 are equipped with perforated cylinders, and two journals 24 as transfer shafts, and one or two bores in the two journals 24, as shown previously by this inventor to permit the internal injection of fluids in any shape or form.

Additional energizing is carried out at the treatment chamber 30 (FIG. 4) situated at the left of the elevator 10. This chamber 30 contains a variety of means to impregnate goods, wind and rewind tight or loose, and to apply a choice of energy transfers.

The lots 3 and 5 enter on cores 4 from the pretreatment range, where they have passed dye and chemical applicators and have acquired the prescribed impregnation with liquid pick-up. They now go to the winding and heating chamber 30. The lots 3 and 5 arrive loaded on carriages 28 and are stationed in locked position on a lifting device 31, such as a scissor lift, or hydraulic cylinder. The carriage 28 is locked into the platform of the lift 31 and the outside end of the roll of goods 3 is attached to the reversible winding beam 32, which is a part of the lifting/platform 31. The carriage 28 has its core 4 connected in a conventional way to the reversible brake/drive 33, also a part of platform 31. This solution permits the temporary use of the carriage 28 in the winding/rewinding operation. The winding beam 32 can be tilted by one or two cylinders,—or mechanically,—towards the surface of the lot 3/5 in order to effect a surface drive or minute slide by contact. The goods from carriage 28 can now either be pulled against a brake at 33, or be driven by 33 and be surface driven on rewind 34, while 34 may be fine tuned with braking controls to cause a fractional slide on 34 amounting to an overfeed and slack winding. Winding tension is automatically measured and controlled.

The chamber 30 contains several sequential treating stations. Contents and arrangements are optional from machine to machine to fit particular processing conditions. FIG. 4 shows an example with infrared winding and rewinding at position 34. The Infrared heaters 35 are arranged in blocks and are approached into the correct proximity by the controlled lifting of the platform 31. This proximity is corrected to the optimum as the diameters shift during the winding/rewinding process. Winding proceeds from 34 to 32, and rewinding returns from 32 to 34. Slack or tight winding progresses under controlled conditions and is accurately adjusted.

On rewinding the carriage 28 obtains again full possession of the lot 3 and with two windings the temperature of the padroll 3 should be close to or at the boiling point of the liquid impregnation, in case of water this is around 100 degree Celsius. The lot 3 is lowered to the floor with A-frame and scissorlift and moved optionally to the ultrasound station 39, to be rewound under ultrasound bombardment with the A-frame raised by the second scissorlift 31 and one winding processing from 34 to 32. Or if a winch is used instead of the lift; a rewind-core 4 is attached on the floor to the outer end of the padroll 3 and both cores 4 are lifted towards the ultrasound station by the two hooks of the winch 40 travelling with the overhead trolley 41. The two journals of the core 4 are deposited in the brackets 42 for the ultrasound station 39 where they connect the journal gear 25 to the driving gear of a brake or motor 43. The suspended core 4 is connected to a positive drive 44 and rewinds under controlled tension or overfeed. A bank of ultrasound horns is in contact with the polished sheet protecting the roll of substrates 3 and spreading the vibrations over a wider area. Horns may be positioned anywhere around the outer surface of the lots 3/5, or on the cores 4. The substrates are rotated underneath the horns either continuously or by using intermittent vibrations by ultrasound. Some soundproofing is placed in the vicinity of the horns. Energizing is state of the art, or indicated in previous specifications of this inventor. Further innovations are in preparation now.

The next optional stops are radio frequency boosting 36, or electric resistance heating 37, or electromagnetic heating 38. At 36 to 38 no rewinding is required; bulk heating is applied. The trolley positions the lots 3/5 into the brackets for rotation during bulk heating.

The processing area of chambers 30, and conveyor chambers 1, do not permit observation of operations from below or from the side, but only through windows, mirrors, or transparent areas (not shown).

Since there are more than one preparation ranges feeding into the conveyor steamer 1, each feeder range may be composed of different machinery and heating elements, using state of the art, and/or new elements, to suit the local mix of materials to be processed.

Of course any number of treatment stations 30 may be arranged in front of the elevator 10 in order to provide adequate supply for the large production capacity of an assembly of stacking conveyors 2. From each station 30 a duct is connected to the conveyor chamber 1 to use excess heat and steam as working energy. Heat exchangers control the actual energy content.

Before loading to the elevator 10 all lots 3 have to be secured. This is done by correct rotation, tying, ribbons, tapes, slip-on cylinders and two side plates, half shells closed, and half shells closed having openings. Wrapping will also provide security against temperature shift, or drying. They are secured automatically or lowered to the floor for handling.

The various lots 3 are now lined up at progressive stations and the most advanced lot 3 at the loading station 45 (FIG. 1) is ready to move on to the hooks 14 of the elevator 10. Any of the transfer means shown previously by the inventor may be used. Another loading station is at 28 where carriages can be entered and loaded over two rails 29.

All lots 3 move over the top of the elevator 10 where they roll forward by gravity from the frontal branch of the stops 14 to the rear-branch of 14. Damping of the gravity force against the stops 14 is optional.

The lots are distributed on the way down to the various conveyors.

The variety of preparation ranges feeding into one multiple conveyor dyeing range necessitates the arrangement of several treatment chambers 30 per conveyor chamber 1. FIG. 5 illustrates four examples of multiple treatment chambers per stacking conveyor 1. They are not connected and may be superimposed over several floors in any conceivable configuration.

Figure 6:
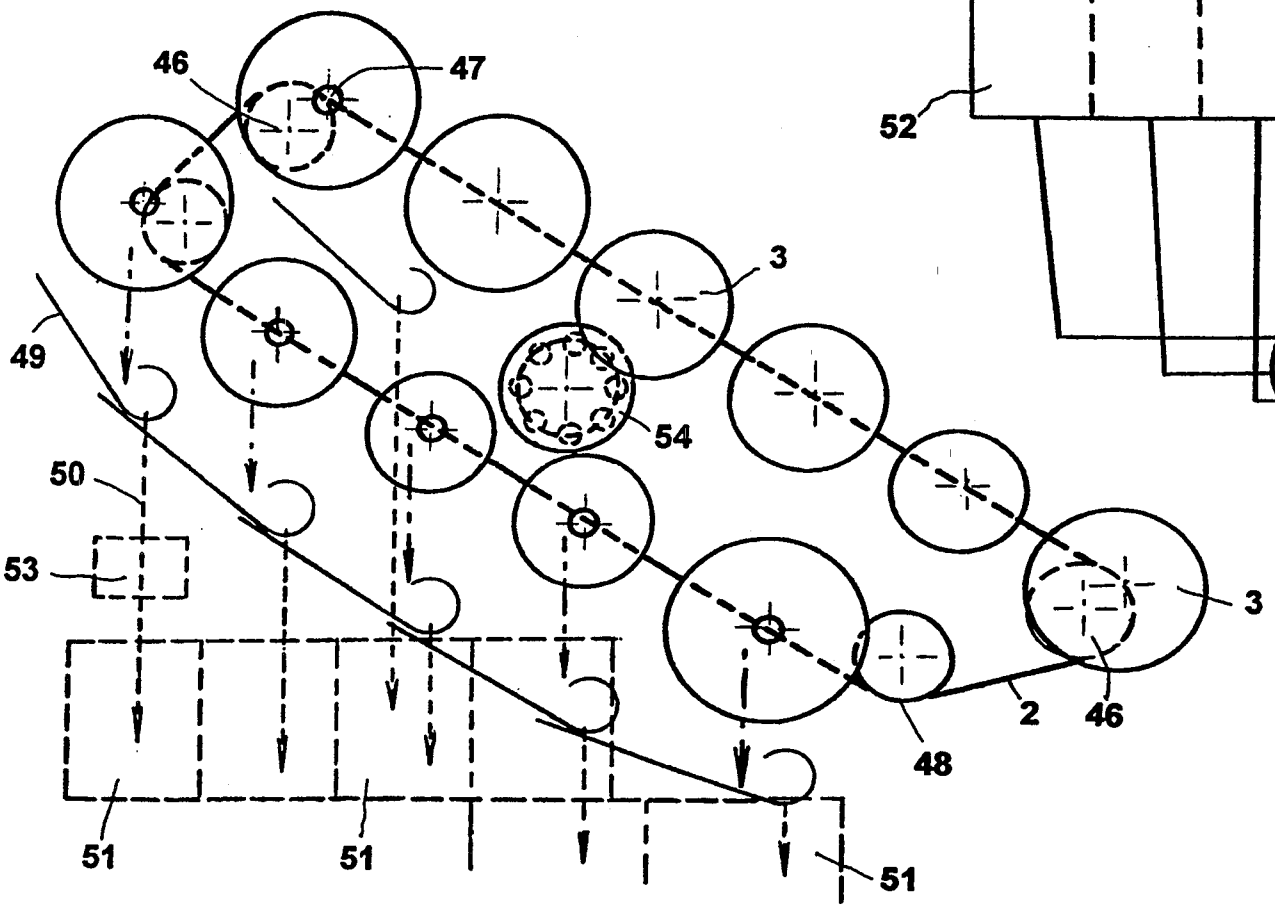
FIG. 6 is a schematic sideview of the doubleacting conveyor combining upward dwelling with downward internal liquid infusion and liquid passage.

This invention shows conveyors in double acting mode. They may be open or in insulated housings. In FIG. 6 the stacking conveyor 2 operates counterclockwise. Impregnated lots 3 are loaded to the upper branch of the conveyor 2 at sprockets 46 and are dwelling under rotation for the diffusion or reaction of chemicals or dyes. The time of exposure is controlled by the forward speed of the conveyor, which is stretched over four sprockets 46 in an endless chain. This example shows a load of 11 padrolls being rotated by gears 25 on the core against stationary racks. The upper branch has the rack at the bottom of the gears, the return branch carries the rack at the top of the gears. This change of location by the racks under the gears 25 prevents the reversal of the sense of rotation at the apex of the conveyor 2. Tying or wrapping of lot 3 is required.

As each lot 3 reaches the top of the conveyor, or thereabouts, a rotary joint 47 is connected to the hollow side of the journal 24 and liquid is entered at a predetermined pressure. The joints 47 travel with the core 4 to the point of exit 48 and are returned before the exit, after disconnection, manually, or mechanically to the start, where they serve the next arrival. The switching station 54 accommodates the joints 47 and the supply lines from the tanks 52.

Liquid solutions, dispersions or slurries are injected from the inside and penetrate the lots 3 on slow rotation exiting at the lowest point of the circumference. Baffles 49 collect the dripping liquid flow 50 and guide it into the collecting tanks 51. Filters 53 are optionally inserted at the flow 50 to prepare liquid from the tanks 51 for recycling into one or more selected supply tanks 52.

The insertion of liquids and gases at the top of the conveyor increases the weight of the downward sector and permits the processing of eleven lots 3 under the gratuitous power of gravity, and with the choice of pressure insertion or gentle trickle in respect to the loaded rolls 3/5. Again, the speed of travel of the conveyor controls the time of dwelling and washing-/development for the present load of the conveyor 2. It will be changed in a time-wave to accommodate various alternating loads.

Figure 7:
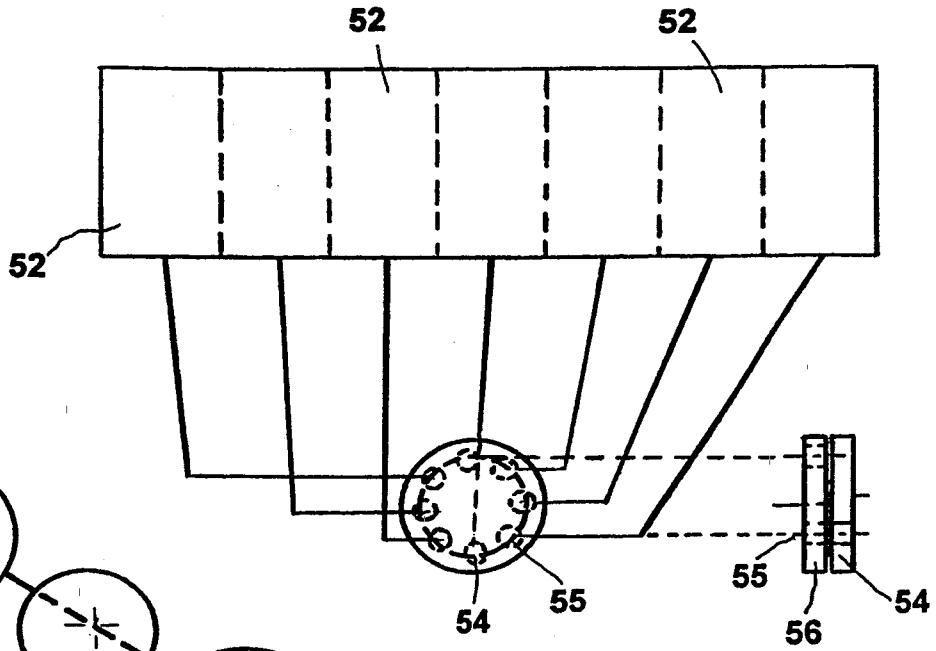
FIG. 7 is a schematic depiction of the liquid supply to the rotary joints.

FIG. 7 explains one version of a switching station 54 directing the flow of compressible and non compressible liquids from supply tanks 52 to the rotary joints 47 by means of suitably placed connecting pipes and switching, or closing, of solenoid valves. Counting from the exit backwards six to eight outlets 55 are selectively in line with one or more supply tanks 52. The joints 47 are connected by flexible hoses to the rotating disk 56, which slides periodically, and fluid-tight, stop by stop, against the disk 54, which is piped in fixed position to seven tanks 52. There are seven supply lines on the fixed disk 54 against eight rotary joints on disk 56. The single blind connector on 54 permits the switch of rotary joints 47 from the exiting lot 3/5 to the next lot 3/5 coming up, while fluid transfer is disconnected. Several tanks 52 can be switched to one outlet 55, and several collecting tanks 51 can be recycled to one or more supply tanks 52.

The rotating disk 56 holds eight equally spaced rotary joints 47. Six to eight joints 47 are connected to six to eight lots 3. As the lots 3 move, the rotating disk 56 with the attached rotary joints 47 moves in small increments proportionally to the advance of the conveyor 2.

Figure 8:
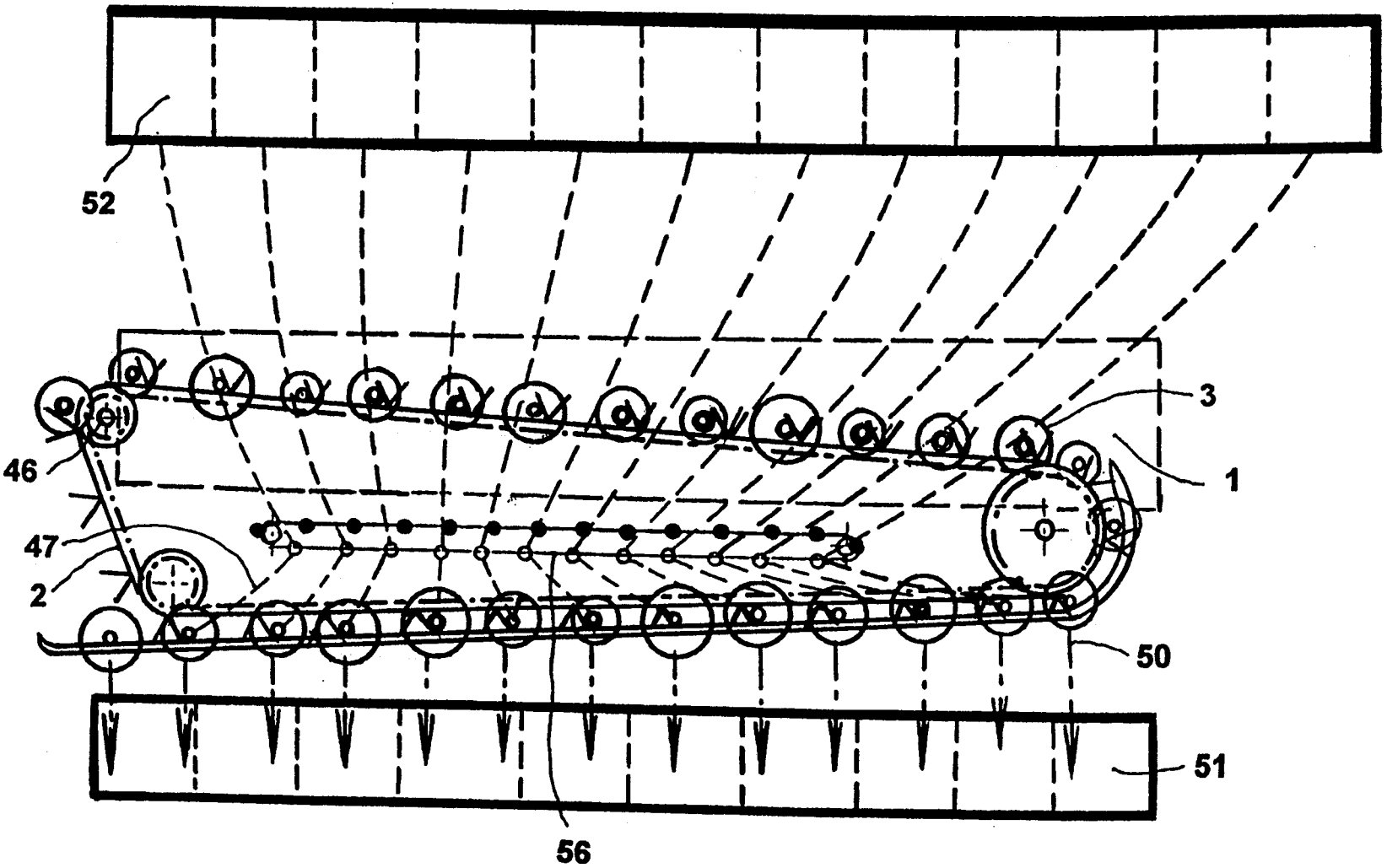
FIG. 8 is a schematic sideview of the horizontal forward and reverse conveyor system combining dwelling and liquid treatment.

The FIG. 8 is an illustration of the nearly horizontal stacking conveyor 2. It provides a very efficient temperature preservation at the upper chamber and has a long stretch of containers 51 useful for very extensive fluid treatment by means of many rotary injection valves 47 under selected pressures. Above the upper chamber 1 are liquid containers 52, or fluid tanks, organized for exchange and recycling with lots 3, or the containers 51.

Figure 9B:
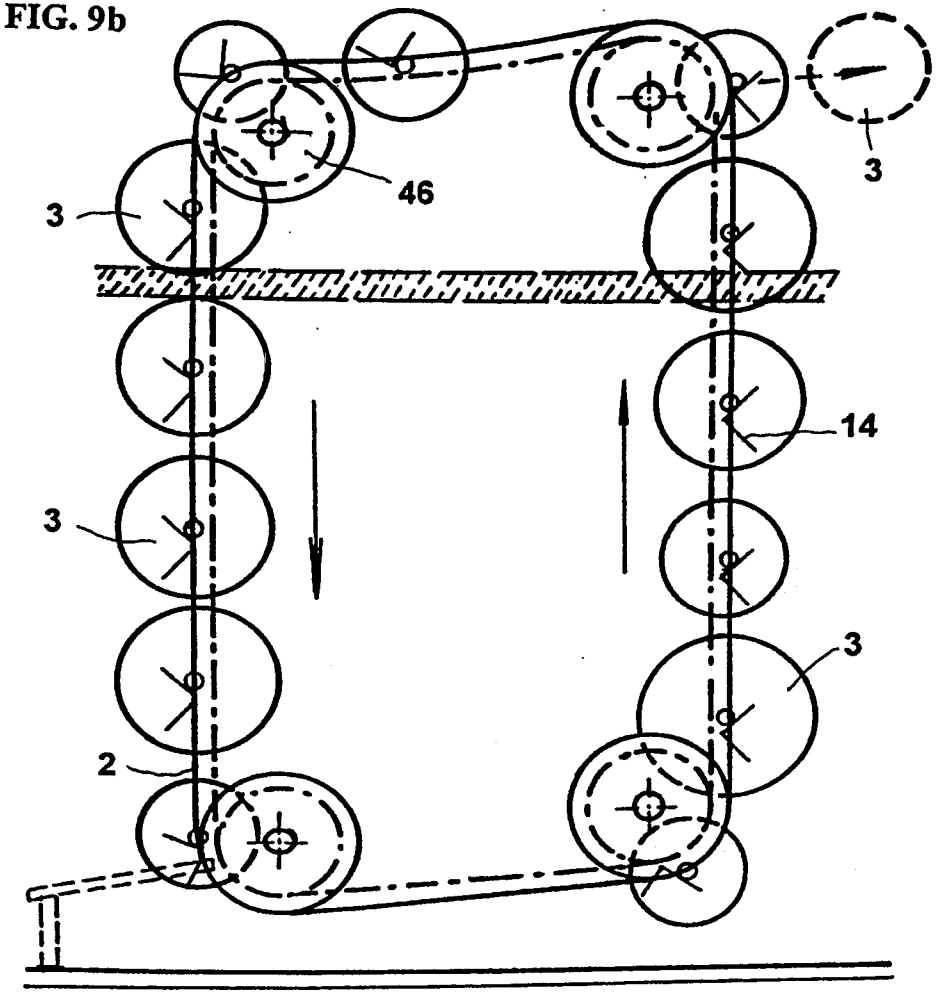
FIG. 9*b* is a schematic sideview of the doubleacting upright conveyor with four reversing sprockets.
Figure 9A:
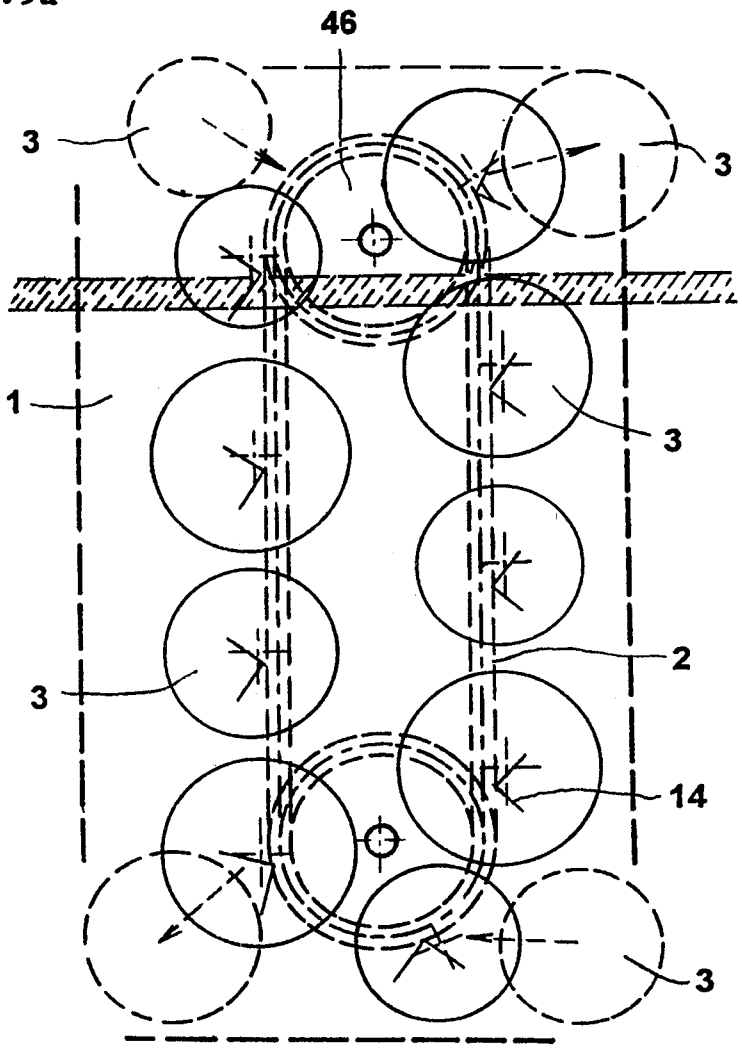
FIG. 9*a* is a schematic sideview of the doubleacting upright conveyor with two reversing sprockets.

The FIGS. 9*a* and 9*b* show two versions of the double acting upright conveyor as it joins the first and second floor operations.

FIG. 9*a* illustrates a continuous upright conveyor with a pair of large reversing sprockets 46 (behind each other)on the floor of the upper platform and another pair at the bottom. The upward traffic lifts lots 3 to the next elevation where they are unloaded. The down movement carries lots 3 either for dwelling, or washing. Arrows mark the place of entry and exit of the loads. The system may be used simply for transportation with largely counterbalanced weight, saving motor power on the uplift.

If an insulated housing is used, it is convenient to use the dissipating heating energy of 100 degree C. in processed lots 3/5 from previous locations on either the up- or down-branch to safeguard the working temperature of 50 C. dwelling operations of fiber reactive dyes at the opposite branch. This means free energy and free dyeing time for the machine.

FIG. 9*b* shows an open, or enclosed, conveyor moving lots 3 or axially centered materials up on one branch and down the other branch. It uses four sprockets for wider spacing, and flexibility for auxiliary services. Lots 3/5 may run either up, or down, or up and down in either direction depending on the task of transportation. The path may be split at will.

As shown double acting conveyors can operate in any direction and at any angle, of course they can also be combined with any other stacking conveyor into aggregates connecting floors and permitting to build operations combining the potential energy of several floors. As example; the fifth floor contains receiving, the fourth floor fabric preparation, the third floor dyeing conveyors, the second floor washing and finishing, and the first floor make-up and shipping.

An arrangement like this may be constructed on a hillside with the receiving at the top and use gravity throughout the plant for all processing and transportation needs. The total savings are very satisfactory in respect to energy conservation.

Figure 10B:
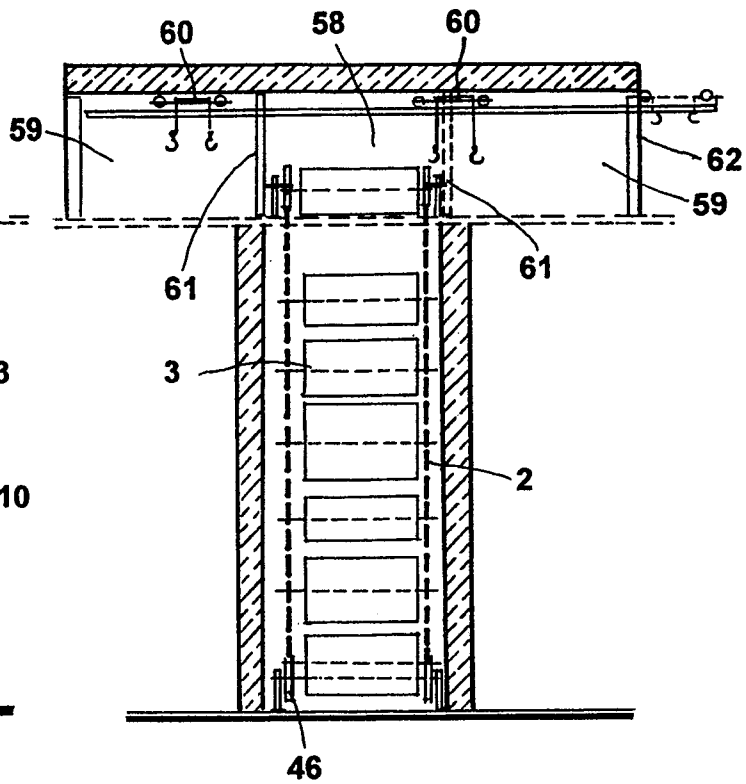
FIG. 10*b* is a schematic frontview of one conveyor in 10*a* illustrating the loading chambers for the substrates.
Figure 10A:
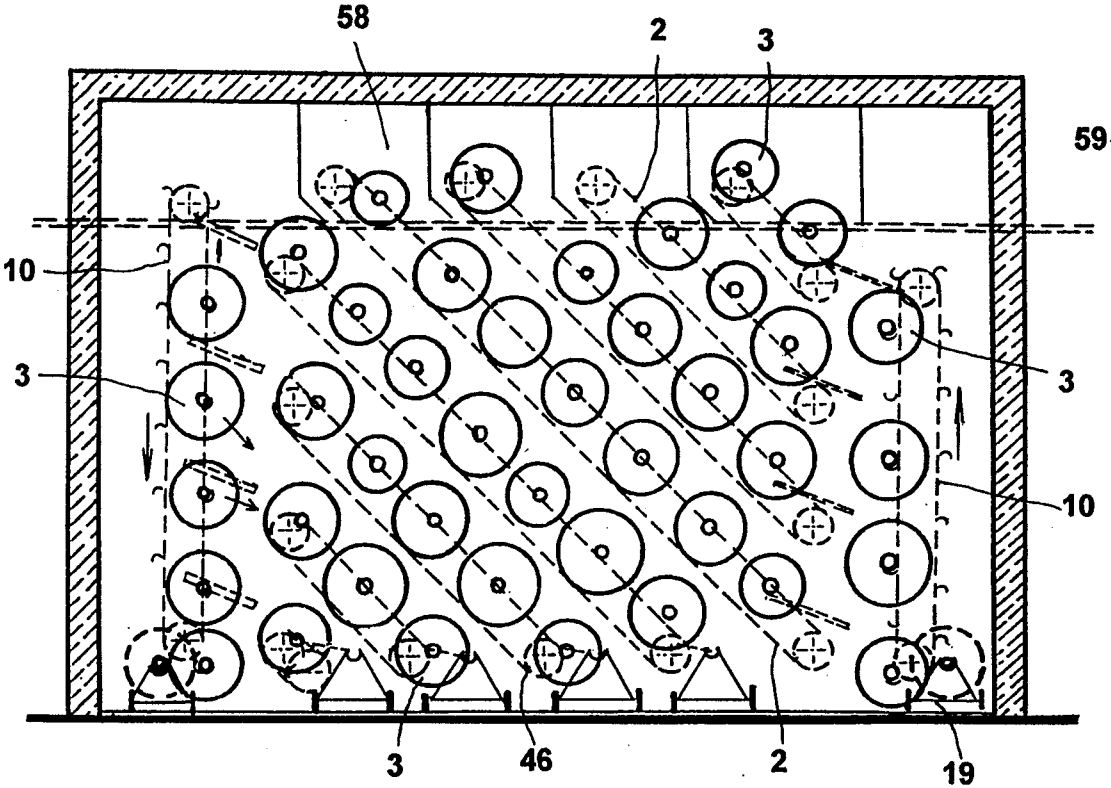
FIG. 10*a* is a schematic sideview of a rectangular conveyor assembly with two up- or down-elevators.

The FIGS. 10*a* and 10*b* indicate very compact up/-down operations.

10*a* represents the basic form with eight variable-length conveyors 2 and two elevators 10. The left one is loading the conveyors from the top or from the left side, while the right elevator 10 unloads processed goods and the bottom unloads to the A-frames 19. The elevators 10 may be loaded from the top or from the bottom.

The FIG. 10*b* is the front view of the selected conveyor at 58. It shows a schematic section with two loading compartments 59 and two trolleys 60, one loading from the left, the other one from the right. Here the lots 3 are staged while the sliding doors 61 to the steam chamber 1 are closed. The lots 3 are suspended from the trolleys 60 and the outer doors 62 are closed. Now the connecting door 61 is opened and the trolley 60 transports the lot 3/5 to the top of the conveyor 2 and deposits it on the loading rail (as FIGS. 1–16), where the hooks 14 of chains 2 pick lot 3 up and move it into processing. The lots 3 move down by gravity and are treated for hours under the control of the hugely variable speed of each conveyor.

FIG. 11 provides the longest possible dwelling time in a sequence of two triangle-type conveyors 63 and one regular conveyor 2. The lots 3 have the choice to run from the very top to the lower conveyor and from there to the bottom conveyor. Lots may enter the system at the locations 64,65,67,68, and 70; and transfer or depart at the locations 66,69, and 71. This illustration shows a total load of 33 lots in one run from top to bottom. The height may stretch over two to three floors. The system is open, or fully, or partially enclosed and can be used in sections from cryogenic to below melting point of the substrates on lots 3. As mentioned before, all conveyors are driven and regulated by DC-drives/brake-motors, converted or coupled with DC-generators. This innovation generates power instead of consuming it.

Figure 12A:
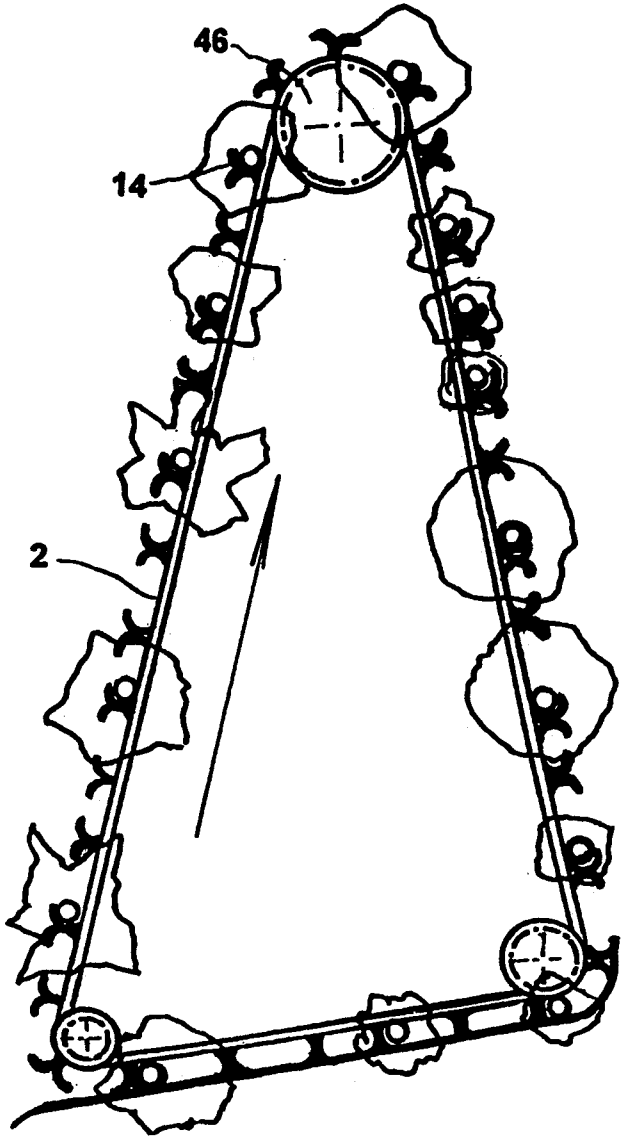
FIGS. 12*a* and 12*b* are two schematic illustrations of the three-sided all around operating conveyor units in sideview.
Figure 12B:
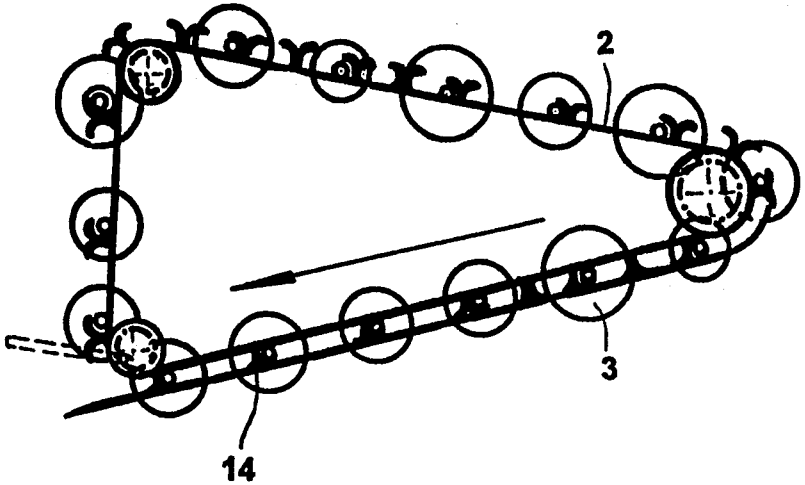

The FIGS. 12*a* and 12*b* show triangle conveyors capable of processing lots 3 over the entire extension of their chain coverage, entering and leaving at any angle of the circumference. This model provides the best utilization of space and can fill a void for a use having the same point of entry and exit. Of course lots 3 exiting can also be recycled for another run. 12*a* is an example for the processing of lots 3; 12*b* works with axially centered masses of any shape or type.

The autoclave 72 in FIG. 13 is used for the dwelling of substrates/materials in either vacuum, atmospheric, or pressure environments, or in any sequence of the three. It is loaded in the conventional manner, either on a regular A-frame 17, or on a custom design providing brackets and a clutch for connection to the drive mechanism 73 entered in sealing fashion through the center of the rear of autoclave 72. The lot 3 illustrated is wound loose and is optionally penetrated by energy and/or fluids, or substances, while rotating in the autoclave 72 at slow speeds. The loose winding under rotation permits the penetration of the lot 3 by vacuum, pressure, fluid media, powders, substances, materials, and temperature in the course of a few turns. One purpose of vacuum is to induce a vigorous state of boiling-/bubbling inside the lot 3, and to facilitate the rise in temperature after change to the injection of superheated steam under pressure. The steam, vapor, or vapor/liquid spray or vapor/suspensions, may be entered through the perforated core 4, or through the wall of the autoclave 72 at 73, 74, or 75 or through nozzles at 76 and 77, while the rotation of the lot proceeds.

The lot 3 at 74 and 75 which is tightly wound and rewound is either preheated to operating temperature, or is rewound inside the autoclave 72 by the connection of one empty and one full core 4 with the two driving clutches 74 and 75 entered through the rear of the autoclave 72 providing a connection to two cores 4, one loaded, and the other holding the end of the lot 3. Another carriage holding both cores at the correct distance from each other is wheeled into the autoclave 72 and connected to the two clutches. After closing, the autoclave is filled under pressure with fluids, materials, or substances, and controlled from freezing to heat, and from vacuum to pressure as appropriate in each case. Winding and rewinding is controlled to apply a variety of tense, slack, or loose conditions at the rolls/lots 3, and fluid/substance insertion is possible through any, or all of the openings at 73,74,75,76, and 77. Two baffles 78 protect the lots 3 from the direct impact of fluid/substances and spread the volume of flow.

Figure 14:
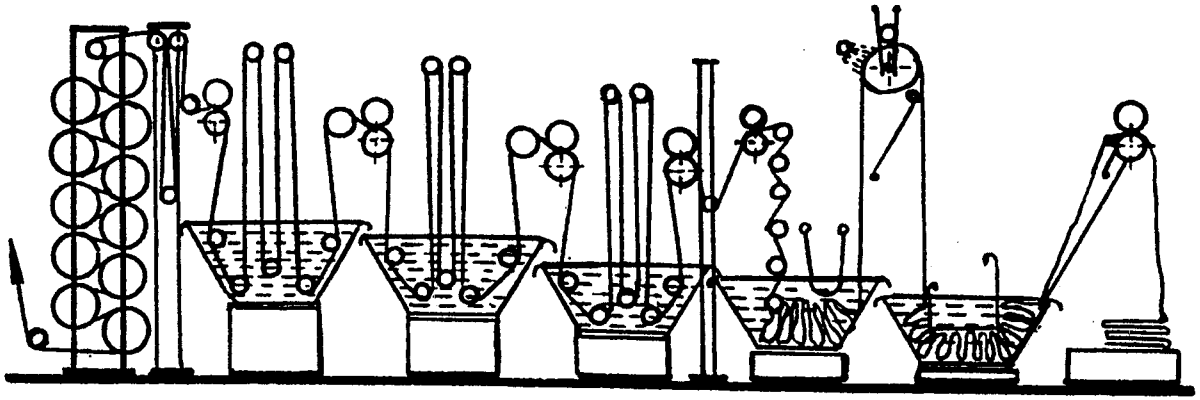
FIG. 14 is a schematic of jiggers in series, using counterflow.

FIG. 14 is a schematic view of modified jiggers operating as auxiliary range from right to left. The jiggers are overflowing to the right and show multiple usage of water by recycling to the right. The cleanest water is at the left and the most contaminated at the right where the cleaning begins. A variety of modifications is shown with storage and dwelling on the right to loosen foreign matter for removal.

Figure 15:
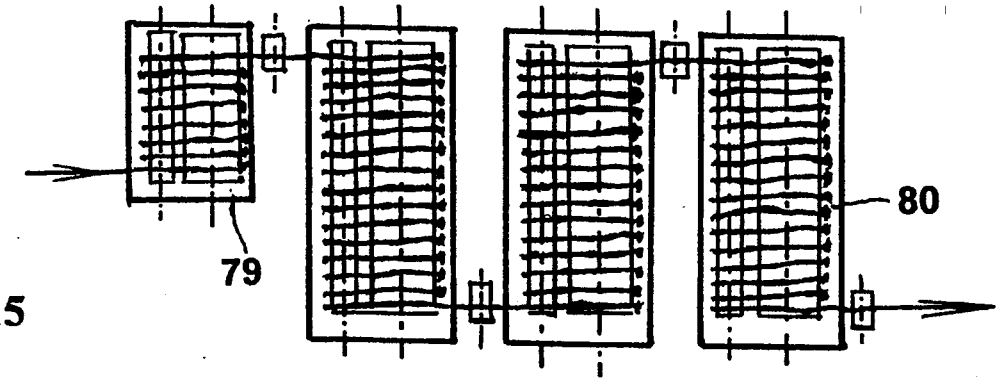
FIG. 15 is a schematic topview of dyebecks in series.

FIG. 15 shows a schematic topview of one or more dyebecks used principally for the physical pounding and bulking of materials. It is part of an auxiliary range used either in preparation, or in washing/finishing. The goods are laced endlessly in ropeform from the first box 79 to the last dye beck 80. This permits the inclusion of several dyebecks in continuous operations. The principal actions are cleaning, washing, and bulking. Auxiliary processing ranges are suitably composed of any mix of equipment;—used, innovative, or state of the art,—to suitably fit the objective.

Figure 16:
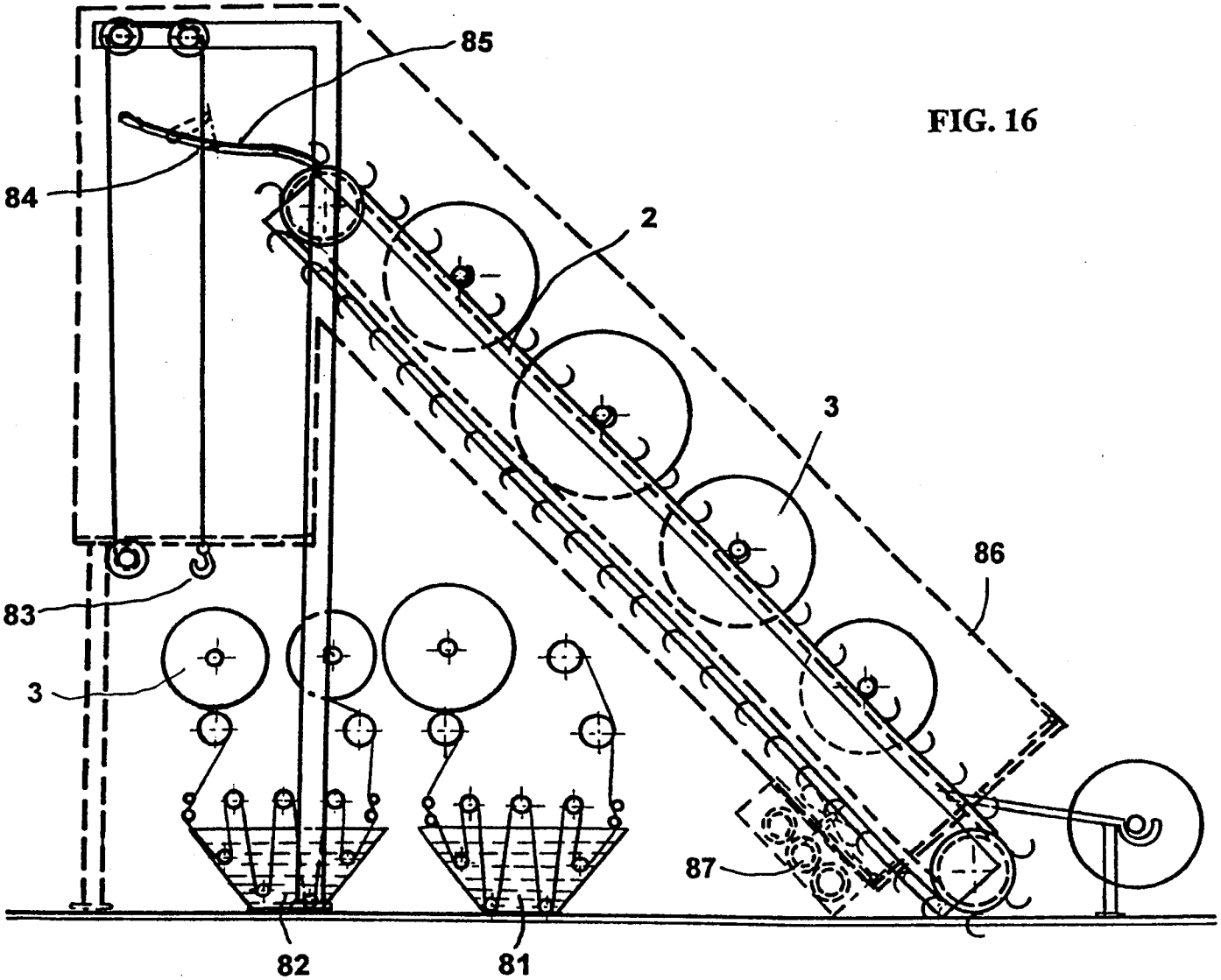
FIG. 16 is a schematic sideview of the use of jiggers as saturators and combined with dwelling in heated chambers.

FIG. 16 demonstrates the use of two jiggers as saturators and precleaning units. By moving from the right 81 to the left jigger 82 the lots 3 achieve two passages of cleaning, heating, and saturation using reversed winding; outside/in—inside/out. They are heated further in the jigger 82 to the dwelling temperature of the conveyor 2 and release the lots after rewinding to the hooks of the winch 83. The lot 3 is than lifted through the opening 84 in the rail 85 and then lowered again, as 84 is closed, to roll down the rail 85 into proximity to the conveyor chain 2, where it is positioned for pickup by the next hook 14. The conveyor is insulated by the housing 86. The heater fan 87 protects the temperature of the lots without actual drying, due to moisture leveling by capillary action of the fibers in the lot 3.

All machinery types and models in this invention illustrate only principal groups and may be modified or combined in very many continuous or semi-continuous arrangements, also using state of the art additions, and converted traditional machines to fill any demands arising from operational practices within the applications.

The materials processed include any solid, amorphous, pliable, or fibrous material; comprising wood, metals, plastics, etc., plus any sheeting, yarn, sliver, top, or other materials capable to benefit from the processing potential. It includes any practicable temperatures demanded for specific end uses and any conceivable modification in purpose.

While only a limited number of embodiments have been illustrated and described, it is apparent that many other variations may be made without departing from the scope of the invention as set forth in the appended claims.

What I claim is:

1. A system and machine for processing substrates and axially centered masses, comprising;

a plurality of diverse workstations, including multifunctional conveyor systems having a loading capacity and length with a variety of processing means, and diverse energy transferring means with instrumentation and controls defining processing environments ranging from cryogenic to near melting of masses, materials, and substrates, and the choice of vacuum- to atmospheric-, to pressurized-workstations;

a variety of conveying means, consisting of highly flexible processing conveyors, used to transport loads and to rotate loads singly or in multiple sets, together with workstations selected from a group of applicators, loading, heating, winding and rewinding, dwelling, unloading, and discharge to the conveyor, the loading capacity and processing time approximately proportional to the lengths of the conveying means while the processing time of the loading capacity is also adjusted by speeding up,- or slowing down,- said conveying means being directed by a plurality of controlling means in a choice of single to multiple planes of transportation;

a plurality of loads processed in said workstations, including restraining means and holding means, the loads consisting of any solid-, amorphous, pliable, or fibrous material, processed in any conceivable selection of materials and any conceivable sequence of the materials, the loads moving in any designated direction, and at any angle from zero degree to 360 degrees;

a choice of energizing means applied controllably to said loads and selected from the group of infrared heaters, high frequency heaters, resistance heaters, electromagnetic heaters, ultrasound energizers, and energized fluids, plus convection and conduction.

2. The system of claim 1, including a plurality of conveyer chains arranged in staggered lengths and in approximately parallel direction of operation, each length representing a different element of a variable time zone for the processing of loads, and including means to control tension, energize and lead substrates and materials, and operating such means on platforms, and with one or more upright feeders, and also including discharging means unloading to a choice of workstations, and of transport devices, and of holding stations, while processing a plurality of loads at predetermined durations adjusted from minutes to many hours.

3. The system of claim 2, also including conveyer chains with stops for each load mounted in parallel, said stops transmitting gravity power from said loads to said conveyer chains; and further including conveyer chains with double-sided stops to pass loads by gravity from forward retaining means to backward retaining means as they pass a summit of said conveyer chains from upwards to downwards, and optionally including damper means to brake the local acceleration of loads past the summit of the conveyer.

4. The system of claim 3, comprising conveyer chains operated by driving means, the driving means switched to power generators, with the multiple loads on the conveyer generating energy, as said multiple loads press against a stops and transport loads, and rotate loads with rotational means fixed on the extremities of the loads, the rotational means engaged with translational means mounted along the path of said conveyer chains causing rotation of said loads and processing a succession of loads without contamination of the machine and without prime movers, while said conveyer chains also rotate sprockets and shafts, said shafts driving power generators.

5. The system of claim 1, comprising workstations enclosed by a choice of full housings, and of partial housings, to contain loads transported on said conveyors, and including selected fluids from the group of air, gases, vapors, and sprays, and a choice of temperatures from cryogenic to near melting of loads, further including distributing means for fluids and temperatures between said work stations, and a selection of pressures from vacuum to high pressure, together with instrumentation and control,—and also including open conveyors transporting loads,—said workstations carrying loads to transfers between stations to continue processing in wet or dry condition.

6. The system of claim 5, also including processing means for loads selected from the group of applicators, loading stations, winding stations and rewinding stations, dwelling stations, fluid insertions, and discharging means.

7. The system of claim 1, using the energy of surplus- and waste-steam as single energizer, or in combination with additional energizers, including instrumentation and control for said energizers; said energizing means confined within the housing while promoting reactions and transformations in respect to loads passing through.

8. The system of claim 1, comprising permeable and non-permeable restraining means for said loads, including pliable and rigid shapes, said loads having extensions supported by conveyor chains, with the restraining means selected from the group of ties, wraps, plates, shells, and cylinders.

9. The system of claim 1, comprising tension controls during the winding and rewinding of substrates, including instrumentation and variable drives to achieve exactly adjusted tensions of predetermined tight to loose layers of linear sheeting controlled throughout a roll of substrates, and variably predetermined at any load.

10. The system of claim 1, including windows, mirrors, and transparent covers.

11. The system of claim 1, comprising venting means between workstations and towards the exterior.

12. A system and machine for processing materials and substrates comprising;

a plurality of diverse workstations, including a variety of processing means, further including conveyor means having a loading capacity and length, driven by constantly replenished loads, the loading capacity and processing time approximately proportional to the lengths of said conveying means, while the duration of the processing is also adjusted by speeding up,—or slowing down the conveying means; while transporting and rotating loads by gravity,—and generating electricity from gravity forces;

a choice of loads selected from the group of masses, materials, and substrates and processed in any sequence of identical and mixed loads, and moving through conditioning means selected from a group of applicators, energizers, modifiers, fluids, and treatment stations, a choice of processing conditioners permitting to modify loads under controlled pressures from vacuum enclosure means to atmospheric pressuures, to pressurized container means, and from cryogenic to near melting temperatures of said loads, in combination with a sequence of workstations selected from a group of processing conditioners in variable sequence adaptable to each individual mass, material, and substrate;

a combination of aggregate blocks of systems, with systems available in multiple sequences and multiple transfer points, providing a variety of processing conditions in a variable choice of operation.

13. The system of claim 12, with a combination of conveyors including a plurality of conveyor chains superimposed in connected operation, said conveyors having each a multiple choice of entry and exit points, and carrying loads selectively from any single entry point to any single exit point on the combination of conveyors, while the loaded conveyors continue processing and transport.

14. The system of claim 12, combining dedicated workstations with traditional equipment.

15. The system of claim 12, assembling specialized workstations with sections of multiple systems and varied equipment for the benefit of specific masses, materials, and substrates.

16. The system of claim 12, combining workstations composed of a choice of conveyor chains, and a choice of housings, with distributing stations inserting a plurality of timed and controlled fluid applications into said loads, in sequence with steps of transportation, and including switching means to change fluids and adjust processing conditions at predetermined intervals, and also comprising filtering and reuse of effluents from the collecting means back to the supplying means, with switching means programmable and controllable from load to load.

17. The system of claim 12, including an autoclave for the processing of loads to be used at any point between workstations, the autoclave selectively employed to rotate and process, to energize loads, to wind and rewind loads; said autoclave having internal openings for the insertion of modifiers from the group of compressible fluids, non-compressible fluids, slurdes, powders, as well as openings for draining and exchange of modifiers; and further including bulk energizers of said loads, and energizers of the substrates during winding, said autoclave operating from freezing to near melting temperatures of said loads and from vacuum conditions to pressurized chambers.

* * * * *